United States Patent [19]

Kojima et al.

[11] Patent Number: 5,028,522

[45] Date of Patent: Jul. 2, 1991

[54] SILVER HALIDE PHOTOGRAPHIC MATERIAL

[75] Inventors: Tetsuro Kojima; Hiroyuki Mifune, both of Kanagawa, Japan

[73] Assignee: Fuji Photo Film Co., Ltd., Kanagawa, Japan

[21] Appl. No.: 436,270

[22] Filed: Nov. 14, 1989

[30] Foreign Application Priority Data

Nov. 14, 1988 [JP] Japan ..... 63-287040

[51] Int. Cl.[5] ..... G03C 1/10; G03C 1/34

[52] U.S. Cl. ..... 430/603; 430/607; 430/611

[58] Field of Search ..... 430/603, 607, 611

[56] References Cited

U.S. PATENT DOCUMENTS

| | | | |
|---|---|---|---|
| 3,681,078 | 8/1972 | Pollet et al. | 430/611 |
| 3,689.273 | 9/1972 | Willems et al. | 430/603 |
| 3,717,466 | 2/1973 | Floreus et al. | 430/611 |
| 3,728,126 | 4/1973 | Pollet et al. | 430/611 |
| 4,111,697 | 9/1978 | Pollet et al. | 430/607 |
| 4,782,013 | 11/1988 | Herz et al. | 430/566 |

*Primary Examiner*—Hoa Van Le

*Attorney, Agent, or Firm*—Sughrue, Mion, Zinn, Macpeak & Seas

[57] ABSTRACT

A silver halide photographic material is disclosed, which contains at least one compound represented by general formula (I) or general formula (II):

$$Z—R-Se—R'—Z' \quad (I)$$

$$Z—R—Se—R'' \quad (II)$$

where R and R′ each individually represent bivalent groups composed of at least one of the following types of atoms carbon atoms, nitrogen atoms, oxygen atoms, sulfur atoms, and selenium atoms; Z and Z′ each individually represent a hydroxyl group, an amino group, an ammonium group, a carboxylic acid group, a salt of a carboxylic acid group, a sulfonic acid group, a salt of a sulfonic acid group, an ether group, a thioether group, a selenoether group, a ureido group, a thioureido group, an oxycarbonylamino group, an acyl group, a sulfonyl group, a carbamoyl group, a carboxamido group, a sulfamoyl group a sulfonamido group, an acyloxy group, a sulfonyloxy group, an oxycarbonyl group, an oxysulfonyl group, or a heterocyclic group; and R″ represents an alkyl group, an cycloalkyl group, an alkenyl group, an aralkyl group, or aryl group.

5 Claims, No Drawings

SILVER HALIDE PHOTOGRAPHIC MATERIAL

FIELD OF THE INVENTION

The present invention relates to a silver halide photographic material. More particularly, the invention relates to silver halide photographic materials in which novel selenoether compounds are used.

BACKGROUND OF THE INVENTION

There has been much past effort aimed at producing a silver halide photographic material which has high photographic speed, is subject to little fogging and suffers little change in its photographic performance during storage.

For example, it has been known for a long time that the use of organic thioethers as silver halide solvents or chemical sensitizers, etc. in the manufacture of silver halide photographic emulsions improves photographic speed.

U.S. Pat. Nos. 3,271,157, 3,531,289, 3,574,628 and 4,057,429, for example, disclose techniques for manufacturing so-called monodisperse silver halide photographic emulsions in which the silver halide grains are of a uniform size by introducing organic thioether compounds in the precipitation stage or at the time of physical ripening. (Hereinafter, silver halide photographic emulsions will be referred to simply as "emulsions").

Also, techniques for increasing the photographic speed of emulsions by introducing organic thioether compounds at the time of chemical ripening in emulsion manufacture or immediately prior to coating have been disclosed, e.g., in U.S. Pat. Nos. 2,521,926, 3,021,215, 3,038,805, 3,506,443, 3,057,724, 3,062,646, 3,574,709, 3,622,329 and 3,625,697.

Further, a technique for increasing the photographic speed of emulsions by using macrocyclic ether compounds containing selenium atoms has been disclosed in U.S. Pat. No. 4,782,013.

There has also been disclosure, in JP-A-53-57817 (the term "JP-A" as used herein means an "unexamined published Japanese patent application"), of a technique for increasing the photographic speed of emulsions by the use of tellurium compounds which contain tellurium atoms and, preferably tellurium compounds which have substituted aromatic rings such as bis-(p-ethoxyphenyl) telluride, at the time of silver halide grain formation.

Although a variety of thioether compounds such as those noted above have been considered to date for the purpose of suppressing the occurrence of fogging while increasing photographic speed, none of these thioether compounds gives fully satisfactory effects.

The organotelluroether compounds of JP-A-53-57817, which discloses the use of telluroether compounds in place of thioether compounds, do indeed have speed enhancement effects. But their effects are still insufficient. Further, these tellurium compounds are unstable in light, heat and oxygen; and it is not easy to synthesize them.

U.S. Pat. No. 4,782,013 discloses compounds which have selenium atoms introduced in place of or in addition to sulfur atoms. However, these compounds are expensive for practical purposes since they are macrocyclic and synthesis of such compounds with good purity is difficult and yields low. In addition, fogging is liable to occur with these compounds, especially in color development.

Another common practice is to use a sensitizing dye to subject silver halide emulsions to so-called spectral sensitization consisting of sensitization up to a wavelength region in which the silver halide itself is not photosensitive.

For example, as may be seen in U.S. Pat. No. 3,506,443, it is known that use of a number of the abovenoted thioether compounds increases the spectrally sensitized speed of green-sensitive silver halide emulsions in which benzoxacarbocyanine or benzimidazolocarbocyanine dyes are employed, but results are still unsatisfactory even in this case.

SUMMARY OF THE INVENTION

It is an object of the present invention to provide an emulsion with which there is no increase in fogging even though the photographic speed is increased.

Another object of the invention is to provide a silver halide emulsion that while spectrally sensitized by high-speed sensitization dyes exhibits little increase in fogging.

Another object of the invention is to provide high-speed silver halide photographic material which suffers little timewise deterioration of photographic performance during storage.

Yet another object of the invention is to provide silver halide photographic material which possesses high-speed and is suitable for rapid development processing and exhibits little occurrence of fogging.

A further aspect of the invention is to provide high-speed silver halide photographic photosensitive material whose synthesis is easy and comparatively inexpensive and in which the abovenoted objects are achieved through the use of novel selenoether compounds.

The objects of the invention are achieved by a silver halide photographic material which contains at least one selenoether compound represented by general formula (I) or general formula (II) below.

General formula (I)

$$Z—R—Se—R'—Z'$$

General formula (II)

$$Z—R—Se—R''$$

In the formulas, R and R' each independently represent bivalent groups composed of at least one of the following type of atoms, carbon atoms, nitrogen atoms, oxygen atoms, sulfur atoms and selenium atoms. Z and Z' each independently represent hydroxyl, amino or ammonium groups, carboxylic acids or their salts, sulfonic acids or their salts or ether, thioether, selenoether, ureido, thioureido, oxycarbonylamino, acyl, sulfonyl, carbamoyl, carboxamido, sulfamoyl, sulfonamido, acyloxy, sulfonyloxy, oxycarbonyl, oxysulfonyl or heterocyclic groups.

R'' represents an alkyl group, cycloalkyl group, alkenyl group, aralkyl group or aryl group.

DETAILED DESCRIPTION OF THE INVENTION

General formulas (I) and (II) are now explained in detail.

Specifically, R and R' each independently represent $(*)\text{-}(R_1—X_1)_n—R_2—$, it being taken that at (*) there is a member that is bonded to a selenium atom of general formula (I) or (II). $R_1$ and $R_2$ each independently represent straight chain or branched alkylene groups whiCh have 1 to 20, preferably 1 to 12, more preferably 1 to 8, most preferably 1 to 4 carbon atoms (e.g., methylene, ethylene, propylene, butylene, hexylene, 1-methylethylene), cycloalkylene groups which have 3 to 20, more preferably 3 to 12, most preferably 3 to 8 carbon atoms (e.g., cyclohexylene), straight chain or branched alkenylene groups which have 3 to 20, preferably 3 to 12, more preferably 3 to 8, most preferably 3 to 4 carbon atoms (e.g., vinylene, 1-methylvinylene), straight chain or branched aralkylene groups which have 7 to 20, more preferably 7 to 12, most preferably 7 to 10 carbon atoms (e.g., benzylidene) or arylene groups which have 6 to 20, more preferably 6 to 14, most preferably 6 to 10 carbon atoms (e.g., phenylene, naphthylene).

$X_1$ represents —O—, —S—, —Se—,

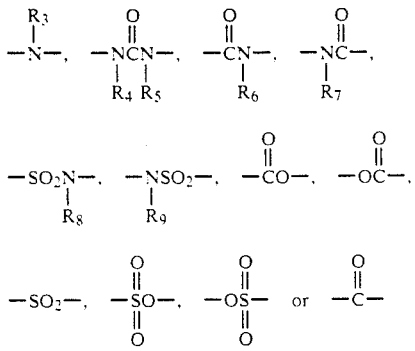

and n represents an integer in the range 0–3. When $n \geqq 2$, $R_1$ and $X_1$ may be any combinations of the abovenoted groups.

$R_3$, $R_4$, $R_5$, $R_6$, $R_7$, $R_8$ and $R_9$ represent substituted or unsubstituted alkyl groups which have 1 to 20, more preferably 1 to 20, most preferably 1 to 6 carbon atoms (e.g., methyl, ethyl, propyl, isopropyl); substituted or unsubstituted aryl groups which have 6 to 20, more preferably 6 to 14, most preferably 6 to 10 carbon atoms (e.g., phenyl, 2-methylphenyl); substituted or unsubstituted alkenyl groups which have 3 to 20, more preferably 3 to 12, most preferably 3 to 6 carbon atoms (e.g., propenyl, 1-methylvinyl); or substituted or unsubstituted aralkyl groups which have 7 to 20, more preferably 7 to 12, most preferably 7 to 10 carbon atoms (e.g., benzyl, phenethyl).

Z and Z' each independently represent hydroxyl groups; carboxylic acids or their salts (e.g., alkali metal or ammonium salts); sulfonic acids or their salts (e.g., alkali metal or ammonium salts); or the following groups optionally substituted by alkyl groups which have 1 to 12 carbon atoms (e.g., methyl, ethyl, propyl, hexyl, dodecyl) or aryl groups which have 6 to 12 carbon atoms (e.g., phenyl, tolyl, p-methoxyphenyl) amino groups (including groups in the form of salts, e.g., unsubstituted amino or dimethylamino groups, hydrochlorides of dimethylamino group, anilino groups); ammonium groups (e.g., trimethylammonium chloride); ether groups (e.g., methoxy, ethoxy, phenoxy); thioether groups (e.g., methylthio, phenylthio); selenoether groups (e.g., methylseleno, ethylseleno, 4-methylphenylseleno); ureido groups (e.g., unsubstituted ureido, 3-methylureido, 3-phenylureido); thioureido groups (e.g., unsubstituted thioureido, 3-methylthioureido); oxycarbonylamino groups (e.g., methoxycarbonylamino, phenoxycarbonylamino); acyl groups (e.g , acetyl, benzoyl); sulfonyl groups (e.g., methylsulfonyl); carbamoyl groups (e.g., unsubstituted carbamoyl, dimethylcarbamoyl); carbonamido groups (e.g., formamido, acetamido, benzoylamido); sulfamoyl groups (e.g., unsubstituted sulfamoyl dimethylsulfamoyl); sulfonamido groups (e.g., methanesulfonamido, benzenesulfonamido); acyloxy groups (e.g., acetyloxy, benzoyloxy); sulfonyloxy groups (e.g., methanesulfonyloxy); oxycarbonyl groups (e.g., methoxycarbonyl, ethoxycarbonyl); oxysulfonyl groups (e.g., methoxysulfonyl) or 3 to 7 membered, preberably 5 or 6 membered heterocyclic groups containing a nitrogen atom, an oxygen atom or a sulfur atom as a hetero atom (e.g., 1-morpholino, 1-piperidino, 2-pyridyl, 4-pyridyl, 2-thienyl, 1-pyrazolyl, 2-imidazolyl, 2-tetrahydrofuryl, tetrahydrothienyl).

R'' represents a substituted or unsubstituted alkyl group which have 1 to 20, preferably 1 to 12, more preferably 1 to 8, most preferably 1 to 4 carbon atoms (e.g., methyl, ethyl, propyl, isopropyl); substituted or unsubstituted cycloalkyl group which have 3 to 20, more preferably 3 to 12, most preferably 3 to 8 carbon atoms (e.g., cyclohexyl, cyclopentyl); substituted or unsubstituted aryl group which have 6 to 20, more preferably 6 to 12, most preferably 6 to 10 carbon atoms (e.g phenyl, 2-methylphenyl); substituted or unsubstituted alkenyl group which have 3 to 20, preferably 3 to 12, more preferably 3 to 8, most preferably 3 to 4 carbon atoms (e.g., propenyl, 1-methylvinyl); or substituted or unsubstituted aralkyl group which have 7 to 20, more preferably 7 to 12, most preferabgly 7 to 10 carbon atoms (e.g., benzyl, phenethyl).

Preferably, $R_1$ and $R_2$ in general formulas (I) and (II) are straight chain or branched alkylene groups which have 1 to 8 carbon atoms or arylene groups which have 6 to 14 carbon atoms, $X_1$ is —O—, —S—, —Se— or

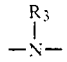

and n is 0 or 1.

Preferably, Z and Z' are hydroxyl groups, amino groups, carboxylic acids or their salts, sulfonic acids or their salts or heterocyclic groups. Preferably, R'' is a substituted or unsubstituted alkyl group which have 1 to 8 carbon atoms or an aryl group which have 6 to 14 carbon atoms.

Particularly preferred cases in general formulas (I) and (II) are the cases where $R_1$ and $R_2$ are straight chain or branched alkylene groups which have 1 to 4 carbon atoms; Z and Z' are hydroxy groups, amino groups or carboxylic acids or their salts; and R'' is a substituted or unsubstituted alkyl group which have 1 to 4 carbon atoms.

The following are specific examples of compounds represented by general formulas (I) and (II), although the compounds of the invention are not limited to these.

(1) $HOCH_2CH_2SeCH_2CH_2OH$ (2) $HO(CH_2)_3Se(CH_2)_3OH$ (3) $HOCH_2\underset{\underset{OH}{|}}{C}HCH_2SeCH_2\underset{\underset{OH}{|}}{C}HCH_2OH$ (4) $HOCH_2CH_2SeCH_2\underset{\underset{OH}{|}}{C}HCH_2OH$ (5) $HOCH_2CH_2Se(CH_2)_3SeCH_2CH_2OH$
(6) $H_2NCH_2CH_2SeCH_2CH_2NH_2$
(7) $HOOCCH_2CH_2SeCH_2CH_2COOH$
(8) $H_2NCH_2CH_2SeCH_2CH_2SCH_2CH_2OH$
(9) $HOCH_2CH_2SCH_2CH_2SeCH_2CH_2SCH_2CH_2OH$

(10) 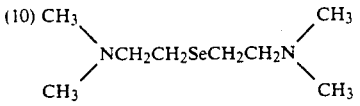

(11) 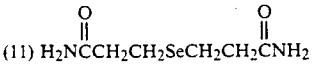

(12) $CH_3OCH_2CH_2SeCH_2CH_2CNH_2$
(13) $NaO_3S(CH_2)_3Se(CH_2)_3SO_3Na$

(14) 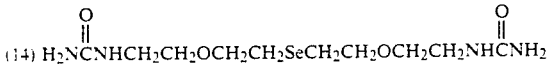

(15) 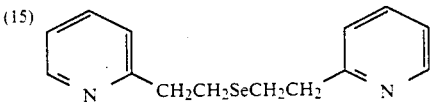

(16) $C_2H_5SeCH_2CH_2OH$

(17) 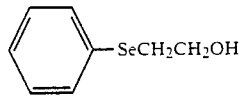

(18) 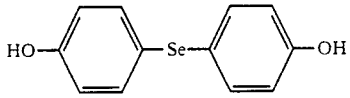

(19) 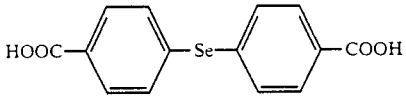

(20) 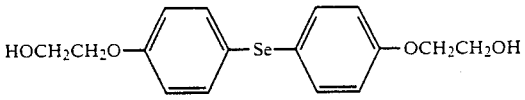

(21) 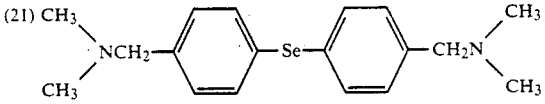

(22) 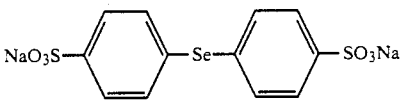

(23) 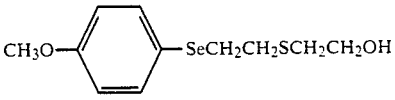

(24) $HOCH_2CH_2OCH_2CH_2SeCH_2CH_2OCH_2CH_2OH$
(25) $HOCH_2CH_2SeC_2H_5$

(26) 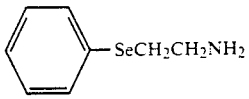

(27) 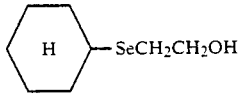

(28) $HOCH_2CH_2SeCH_2CH_2SeCH_2CH_2OH$

The addition layer of the selenoether compound of the present invention is preferably a silver halide emulsion layer. But it can be added to another layer.

The compounds of the invention representable by general formulas (I) and (II) can be synthesized by reference to the methods described in, e.g., *The Chemistry of Organic Selenium and Tellurium Compounds*, Volume 2, p. 495 (1987, John Wiley & Sons Ltd.); *Acad. Sci., Ser. C*, 263, 1481 (1966); *Anorg. Allg. Chem.*, 352, 295 (1967); *Organometallics*, 1, 739 (1982); or *J. Am. Chem. Soc.*, 60, 619 (1938).

The selenoether compounds of the invention have the great advantage of being chain compounds that are easier to synthesize and more easily purified than the cyclic selenoether compounds of U.S. Pat. No. 4,782,013.

Preferably in the invention, the organic selenoether compounds are added to the emulsion during at least one stage of emulsion manufacture; the time of silver halide precipitate formation, the time of subsequent physical ripening or chemical ripening and the stage immediately prior to coating. Addition of the organic selenoether of the invention at the time of precipitate formation or the time of physical ripening or chemical repening is preferred. The amount of organic selenoether compound added is generally 0.001 to 30 g, preferably 0.03 to 10 g per 1 mol of silver halide.

Any normal method known in the art may be used for forming silver halide grains for an emulsion according to the invention, but the double jet method is preferred.

The double jet method is one in which a silver nitrate aqueous solution and an aqueous solution of one or more halides (e.g., alkali metal halides such as potassium bromide) are added simultaneously by two separate jets to a stirred solution of a silver halide protective colloid (e.g., gelatin or a gelatin derivative).

For the addition of organic selenoether compounds at the time of silver halide precipitate formation and/or physical ripening in the invention, it is preferable that the compound is added to a protective colloid solution before the start of precipitation. Such an addition can be via the abovenoted jets used for adding halides and/or silver nitrate, or via a separate jet.

The photographic emulsion in the invention can be prepared by methods such as described by, e.g., P. Glafkides, *Chimie et Physique Photographique* (Paul Montel Co., 1967); G. F. Duffin, *Photographic Emulsion Chemistry* (The Focal Press, 1966); and V. L. Zelikman et al., *Making and Coating Photographic Emulsion* (The Focal Press, 1964). That is, the method employed may be an acidic, a neutral, an ammonia method. In reacting soluble silver salts with soluble halogen salts, a single jet mixing method, a double jet mixing method or a combination of such methods may be employed.

It is also possible to use a method in which grains are formed in the presence of an excess of silver ions (the so-called reverse mixing method).

The silver halide grain size distribution in this photographic emulsion may be any distribution. Preferred is a monodisperse system. "Monodisperse system" as used herein signifies a system in which 95% of the grains come within ±60% and preferably within ±40% of the number average grain size, where "number average grain size" means the number average diameter of the projected area diameters of the silver halide grains.

A mixture of two or more types of separately formed silver halide emulsions may be used.

As silver halide, silver bromide, silver iodobromide, silver iodochlorobromide, silver chlorobromide, silver iodide and silver chloride may be used in the photographic emulsion of the invention.

The grain size distribution may be narrow or broad.

The silver halide grains in the photographic emulsion may be grains possessing cubic, octahedral, tetradecahedral, rhombic dodecahedral or similar regular crystals, grains with spherical, tabular or similar irregular crystal forms, or grains with composite forms combining these crystal forms. The emulsion may also consist of a mixture of grains with a variety of crystal forms. Also, the crystals may be crystals with higher order index planes.

The silver halide grains may have different phases in their interiors and outer surface layers or they may be of a uniform phase. They may also be grains with a double layer structure or a multilayer structure.

The crystals may also be, e.g., joined type silver halide crystals in which crystals of an oxide such as PbO and crystals of a silver halide such as silver chloride are bonded to one another; epitaxially grown silver halide crystals (e.g., crystals in which silver chloride, silver iodobromide or silver iodide, etc. are epitaxially grown on silver bromide): or crystals with cubic silver chloride in overlapping orientation on orthohexagonal silver bromide.

Use may also be made of tabular silver halide grains with an aspect ratio that is 3 or more and preferably 5 to 20. Such grains are described in detail in, e.g., U.S. Pat. Nos. 4,434,226 and 4,439,520, European Pat. No. 84,637A2, JP-A-59-99433 and *Research Disclosure* Vol. 255, 22534 (January 1983).

The silver halide grains may also be formed by the methods described in JP-A-l-183417, JP-A-l-183644 and JP-A-1-183645.

There are no particular restrictions regarding conditions such as the pH, pAg and temperature, etc. at the time of silver halide grain formation in the invention. Preferably the pH value is held at about 1 to about 10, 2 to 8 being particularly preferred, and the pAg value at about 5 to about 11, 7.8 to 10 being particularly preferred.

The silver halide grains can be formed with the temperature in the range about 30° C. to about 90° C., with 35° to 80° C. particularly preferred.

Needless to say, there is no objection to the pH, pAg or temperature being varied during silver halide grain formation.

Cadmium salts, zinc salts, lead salts, thallium salts, iridium salts, rhodium salts, iron salts, or complex salts thereof, may be introduced during the course of silver halide grain formation or physical ripening. The amount of these substances added may be large or small depending on what the target photosensitive material is.

The amount of organic selenoether compound or compounds of the invention added at the time of silver halide grain formation can be made 0.001 to 30 g per 1 mole of silver halide and is preferably 0.003 to 10 g, 0.01 to 3 g being particularly preferred.

The abovenoted thioether compounds, substances such as ammonia, thiocyanates (e.g., potassium thiocyanate), and the compounds disclosed in JP-B-58-51252, JP-B-55-77737 (the term "JP-B" as used herein means an "examined Japanese patent publication"), U.S. Pat. No. 4,221,863, and JP-B-60-11341 may be used together with the selenoether compounds of the invention.

If the organic selenoether compounds of the invention are used prior to the time of chemical ripening (e.g., at the time of silver halide grain formation), they can be treated to prevent them from active as silver halide solvents according to the method disclosed in JP-A-60-136736.

As noted, the invention also encompasses the addition of selenoether compounds to the chemical ripening stage of emulsion manufacture. More specifically, the amount of organic selenoether compound added is 0.001 to 10 g per 1 mole of silver halide. Particularly preferred is 0.003 to 1 g.

Regarding the addition of compounds according to the invention to the chemical ripening stage, there are no particular restrictions of conditions such as the pH, pAg, temperature, or time, etc, beyond conditions that are normally set by workers in the field.

For example, a preferred pH value is 3.0 to 8.5, (5.0 to 7.5 being particularly preferred). A preferred pAg value is 7.0 to 9.5, (8.0 to 9.3 being particularly preferred), a preferred temperature is 40° to 85° C. (45 to 75° C. being particularly preferred) and a preferred time is 5 to 200 minutes (10 to 120 minutes being particularly preferred).

As noted above, according to the invention it is also possible to add the organic selenoether compounds in the stage immediately prior to coating. More specifically, the amount added in such case is 0.001–10 g and particularly preferred is 0.003 to 5 g per 1 mole of silver halide.

To remove soluble salts from the emulsion following precipitate formation or physical ripening, one may use the noodle washing process in which gelatin is gelled or a precipitation process (flocculation process) in which use is made of inorganic salts, anionic surfactants, anionic polymers (e.g., polystyrenesulfonic acid) or gelatin derivatives (e.g., acylated or carbamoylated gelatin).

Normally, silver halide emulsions are chemically sensitized. The processes described in, e.g., "Die Grundlagen der Photographischen Prozesse mit Silberhalogeniden", H. Frieser ed. (publ. Akademische Verlagsgesellschaft, 1968) pages 675 to 734 can be used for chemical sensitization. For example, processes such as the sulfur sensitization process (using activated gelatin or a sulfur-containing compound that can react with silver ions); the selenosensitization process (e.g., using dimethylselenourea), the reduction sensitization process (using a reducing substance); and the noble metal sensitization process (using gold or other noble metal compounds) can be used alone or in combination. Thiosulfates (e.g., sodium thiosulfate), thioureas (e.g., triethylthiourea, acetylthiourea, diphenylthiourea), thiazoles, rhodanines (e.g., 5-benzylidene-3-ethylrhodanine) and other compounds that release unstable sulfur can be used as sulfur sensitizers.

Substances that can be used as reduction sensitizers include stannous salts; amines; hydrazine derivatives; formamidinesulfinic acid; and silance compounds. Substances that can be used as noble metal sensitizers include chloroauric acid; dithiocyanatoauric salts and similar complex gold salts (but aurous cyanide is unsuitable); and also complex salts of periodic table group VIII metals such as platinum, iridium and palladium.

Sensitization processes using noble metals in the form of gold compounds, and the like; and sensitization processes using sulfur compounds are particularly preferred.

In order to improve speed and contrast and to speed up development, one may include, e.g., polyalkylene oxide (or ether, ester, amine or similar derivatives thereof); thioether compounds; thiomorpholine compounds; quaternary ammonium salt compounds; urethane derivatives; urea derivatives; imidazole derivatives; or 3-pyrazolidones. For example, one may make use of the substances disclosed in U.S. Pat. Nos. 2,400,532, 2,423,549, 2,716,062, 3,617,280, 3,772,021 and 3,808,003.

A variety of compounds can be included for the purpose of preventing fogging in the course of photosensitive material manufacture and during storage and photographic processing. That is, one may add many compounds that are known as antifoggants or stabilizers, examples include azoles (e.g., benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles, (especially 1-phenyl-5-mercaptoterazole)); mercaptopyrimidines; mercaptotriazines; thioketo compounds (such as oxazolinethione); azaindenes (e.g., triazaindenes, tetraazaindenes, (especially 4-hydroxy-substituted (1,3,3a,7) tetraazaindenes), and pentaazaindenes); benzenesulfinic acid; benzenesulfonic acid amides; and benzenethiosulfonic acid.

Use of gelatin as a binder or protective colloid that is employed in the invention is advantageous but apart from this it is also possible to use, e.g., hydrophilic macromolecular substances. The forms of gelatin that may be employed include lime-treated gelatin, acid-treated gelatin and derivative gelatin.

Photographic emulsion layers and other hydrophilic colloid layers in photosensitive material prepared using the invention may include coating assistants and various known surfactants for a variety of purposes such as prevention of static electricity, improvement of slip characteristics, emulsification dispersion, prevention of sticking and improvement of photographic characteristics (e.g., quicker development, higher contrast, increased speed).

Preferably, the photographic emulsion of the invention is spectrally sensitized by methine dyes or other substances. Dyes that may be employed comprise cyanine, merocyanine, complex cyanine, complex merocyanine, holopolar cyanine, hemicyanine, styryl, and hemioxonol dyes. Dyes belonging to the merocyanine and complex merocyanine dye groups are particularly useful. The basic heterocyclic ring nuclei for these dyes may be any nuclei that are normally used in cyanine dyes. That is, nuclei that may be employed include pyrroline, oxazoline, thiazoline, pyrrole, oxazole, thiazole, selenazole, imidazole, tetrazole, and pyridine nuclei; nuclei in which alicyclic hydrocarbon rings are fused with these nuclei; and nuclei in which aromatic hydrocarbon rings are fused with these nuclei, i.e., nuclei such as indolenine, benzindolenine, indole, benzoxazole, naphthooxazole, benzothiazole, napthothiazole, benzoselenazole, benzimidazole and quinoline nuclei. These nuclei may be substituted on carbon atoms.

Pyrazolin-5-one, thiohydantoin, 2-5hiooxazolidine-2,4-dione, thiazolidine-2,4-dione, rhodanine, thiobarbituric acid nuclei and similar 5–6 membered heterocyclic ring nuclei may be used as nuclei possessing ketomethylene structures in merocyanine or complex merocyanine dyes.

The photographic emulsion of the invention may contain dye-forming couplers, i.e., compounds which react with the oxidation products of aromatic amine (usually a primary amine) developing agents to form dyes (these are referred to below simply as "couplers"). It is desirable that the couplers be nondiffusing couplers possessing hydrophobic groups called ballast groups in their molecules. The couplers may be 4-equivalent or 2-equivalent with respect to silver ions. One may also include colored couplers which have color compensation effects or couplers which release development inhibitors as development proceeds (what are called DIR couplers). The couplers may also be couplers whose coupling reaction products are colorless.

Known open chain ketomethylene couplers can be used as yellow-forming couplers and of these benzoylacetoanilide and pivaloylacetoanilide compounds offer advantages.

The magenta couplers that one may use include pyrazolone compounds, pyrazoloazole compounds, indazolone compounds, and cyanoacetyl compounds; pyrazolone compounds being particularly advantageous.

The cyan couplers that one may use include phenol compounds and naphthol compounds.

Other compounds, apart from DIR couplers that release development inhibitors as development proceeds, may be included in the photosensitive material, it being possible to use, e.g., the compounds disclosed in U.S. Pat. Nos. 3,297,445 and 3,379,529 and West German Patent Application (OLS) 2,417,914.

The abovenoted couplers may be included in the same layer or in two or more different layers. Also, one compound may be included in two or more layers.

Known methods, e.g., a method such as disclosed in U.S. Pat. No. 2,322,027, may be used for introducing couplers into silver halide emulsion layers.

The emulsion of the invention is normally used after undergoing physical ripening, chemical ripening and spectral sensitization. Additives that are used in these stages are described in *Research Disclosure* Vol. 176, No. 17643 (December 1978) and Vol. 187, No. 18716 (November 1979) and the relevant places in this journal are listed in the table below. These two volumes of *Research Disclosure* also describe known photographic additives that can be used conjointly in the invention and the following table also notes where these additives are described.

| Type of additive | RD17643 | RD18716 |
|---|---|---|
| 1. Chemical sensitizers | p. 23 | p. 648 r.h. col. |
| 2. Speed improvers | | " |
| 3. Spectral sensitizers | P. 23 to 24 | p. 649 r.h. col. |
| 4. Super sensitizers | | p. 649 r.h. col. |
| 5. Brightening agents | P. 24 | |
| 6. Antifoggants and | p. 24 to 25 | p. 649 r.h. col. |

-continued

| Type of additive | RD17643 | RD18716 |
|---|---|---|
| stabilizers | | |
| 7. Couplers | p. 25 | |
| 8. Organic solvents | p. 25 | |
| 9. Light absorbers, filter dyes, and UV ray absorbers | p. 25 to 26 | p. 649 r.h. col. to l.h. col. |
| 10. Stain inhibitors | p. 25 r.h. col. | p. 650 l.h. col. to r.h. col. |
| 11. Color image stabilizers | P. 25 | |
| 12. Hardeners | P. 26 | P. 651 l.h. col. |
| 13. Binders | p. 26 | " |
| 14. Plasticizers, lubricants | P. 27 | P. 650 r.h. col. |
| 15. Coating assistants, surfactants | P. 26 to 27 | " |
| 16. Antistatic agents | P. 27 | " |

The silver halide emulsion of the invention can be used in black and white silver halide photographic photosensitive material (e.g., X ray sensitive material, lithographic photosensitive material and negative film for black and white projections) or in color photographic photosensitive material (e.g., color negative film, color reversal film and color paper). It can also be used in, for example, photosensitive material for diffusion transfer (e.g., color diffusion transfer elements and silver salt diffusion transfer elements) and heat developable photosensitive material (black and white or color).

The photographic emulsion of the invention can be coated by methods such as a dip coating, roller coating, curtain coating and extrusion coating on plastic film, paper or similar flexible supports or glass or similar rigid supports that are normally used for photographic material. Useful flexible supports include a semisynthetic or synthetic macromolecular film such as cellulose nitrate, cellulose acetate, cellulose acetobutyrate, polystyrene, polyvinyl chloride, polyethylene terephthalate or polycarbonate, or paper coated or laminated with baryta layers, or an $\alpha$-olefin polymer (e.g., polyethylene, polypropylene, ethylene/butene copolymer).

Any known method may be used for photographic processing of photosensitive material produced using the invention and known solutions may be used as the processing solutions. Normally, a temperature between 18° C. and 50° C. is selected as the processing temperature but this temperature may be lower than 18° C. or higher than 50° C. Depending on the objective for using the photographic material of the invention, one may either use image processing for forming silver images (black and white photographic processing) or use color photographic processing consisting of development processing for forming dye images.

A more detailed description of the methods affecting development processing may be found in *Research Disclosure* Vol. 176, No. 17643, pages 28 to 29 and Vol. 187, No. 18716, page 651 left-hand column to right-hand column.

The application will now be described in further detail with reference to examples, but these examples are not intended as limiting.

EXAMPLE 1

While being stirred vigorously and held at 75° C., an aqueous solution containing gelatin and potassium bromide underwent simultaneous addition of an aqueous solution of silver nitrate and a mixed aqueous solution of potassium bromide and potassium iodide. The resulting monodisperse tetradecahedral silver iodobromide emulsion which contained 2 mol % of silver iodide and which had an average grain size of 0.80 $\mu$m was prepared.

Unwanted salts were removed from this emulsion by a flocculation process, and the pH was adjusted to made 6.3 and the pAg was adjusted to 8.4. The emulsion was then divided into 11 portions to each of which was added sodium thiosulfate (an addition amount of 3 mg/l mole of silver halide) and the compounds noted in Table 1. Each portion was chemically sensitized at 60° C. so as to give optimum speed on 1/100 second exposure.

Additionally added to these emulsions were the sensitizing dye, stabilizer, hardener and coating assistant noted below, each was then coated on a polyethylene terephthalate film support together with a gelatin surface protection layer by simultaneous extrusion process. The dried products constitute Samples 1 to 11.

| | |
|---|---|
| Sensitizing dye: | anhydro-5-chloro-9-ethyl-5'-phenyl-3'-sulfoethyl-3-(sulfopropyl)oxacarbocyaninehydroxide sodium salt |
| Stabilizer: | 4-hydroxy-6-methyl-1,3,3a,7-tetra-azaindene |
| Hardener: | 2,4-dichloro-6-hydroxy-1,3,5-triazine sodium salt |
| Coating assistant: | sodium dodecylbenzenesulfonate |

The samples produced were exposed (1/100 second) via an optical wedge and yellow film using a sensitometer, subjected to 20 seconds development at 35° C. with RD-III development solution (manufactured by Fuji Photo Film Co., Ltd.) for automatic development units and fixed, washed, and dried by normal procedure. The photographic speed was measured and expressed as a relative value, taking Sample 1's photographic speed as 100, of the reciprocal of the amount of exposure needed to produce an optical density equal to the fogging value +0.2. The results are presented in Table 1.

TABLE 1

| Sample No. | Compound | Amount added (g/mol of silver halide) | Relative speed | Fogging |
|---|---|---|---|---|
| 1 | — | — | 100 | 0.09 |
| 2 | (1)* | 0.27 | 245 | 0.20 |
| 3 | (5) | 0.12 | 285 | 0.14 |
| 4 | (8) | 0.09 | 220 | 0.12 |
| 5 | " | 0.12 | 305 | 0.15 |
| 6 | (9) | 0.06 | 229 | 0.21 |
| 7 | (10) | 0.09 | 215 | 0.18 |
| 8 | (15) | 0.12 | 208 | 0.16 |
| 9 | Comparative Compound (a) | 0.09 | 159 | 0.11 |
| 10 | Comparative Compound (a) | 0.12 | 178 | 0.21 |
| 11 | Comparative Compound (a) | 0.27 | 204 | 0.43 |

Comparative Compound (a): 3,6-dithia-1,8-octanediol (Compound disclosed in U.S. Pat. No. 3,021,215)

*The numbers refer to the specific examples of general formulas (I) and (II) described above.

As is clear from Table 1, use of compounds of the invention resulted in a marked increase in spectral sensitization speeds. A material with which there was less occurrence of fogging but higher attainable speed than in the case of a conventional thioether compound was obtained.

EXAMPLE 2

A silver iodobromide emulsion consisting of tabular twin-crystal grains which had an average iodine content of 8 mol % and a high internal iodine type double structure with a core/shell ratio of 1:3 and whose equivalent sphere diameter was 0.7 μm and diameter/thickness ratio was 5.0 was prepared. Starting with 3,6-dithia-1,8-octanediol, hydrogen peroxide was added at the time of formation of grains for the core portions, a silver nitrate aqueous solution and a mixed aqueous solution of potassium bromide and potassium iodide were then added by the double jet process for the shell portions. This emulsion was given a gold-sulfur sensitization treatment by adding chloroauric acid, potassium thiocyanate and sodium thiosulfate and then heated the mixture for 45 minutes at 60° C.

The resulting emulsion was divided into 5 portions and after the addition of spectral sensitizing dyes (Sensitizing dyes I, II and III), the compounds noted in Table 2 were added. Additionally added to each portion were the coupler dispersions (Cp-1, Cp-2, Cp-3, Cp-4, Oil-1, Oil-2), an antifoggant (1-(m-sulfophenyl)-5-mercaptotetrazole·monosodium salt), a stabilizer (4-hydroxy-6-methyl-1,3,3a,7-tetra-azaindene), a hardener (H-1), coating assistants (sodium p-dodecylbenzene-sulfonate, and sodium p-nonylphenoxypoly(ethylenoxy)propane-sulfonate). (Structures for these additives are given below). The samples were coated on cellulose triacetate supports together with gelatin surface protective layers and dried to constitute Samples 12 to 16.

The samples were exposed (1/100 second) via an optical wedge and subjected to color development processing as noted below. The photographic characteristics were measured and are given in Table 2.

Similarly to the procedure of Example 1, for the speed values in Table 2 the speed of Sample 12 is taken to be 100 and the other values are relative to this.

| Color Development Processing: | | |
|---|---|---|
| 1. | Color development | 2 minutes 45 seconds (38° C.) |
| 2. | Bleaching | 6 minutes 30 seconds |
| 3. | Washing | 3 minutes 15 seconds |
| 4. | Fixing | 6 minutes 30 seconds |
| 5. | Washing | 3 minutes 15 seconds |
| 6. | Stabilization | 3 minutes 15 seconds |

The processing solution compositions used in the various stages of Example 2 were as follows:

| | |
|---|---|
| Color development solution: | |
| Sodium nitrilotriacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4-(N-Ethyl-N-β-hydroxyethylamino)-2-methylaniline sulfate | 4.5 g |
| Water to make | 1 liter |
| Bleaching solution: | |
| Ammonium bromide | 160.0 g |
| Aqueous ammonia (28%) | 25.0 ml |
| Sodium ethylenediaminetetraacetato ferrate | 130.0 g |
| Glacial acetic acid | 14.0 ml |
| Water to make | 1 liter |
| Fixing solution: | |
| Sodium tetrapolyphosphate | 2.0 g |
| Sodium sulfite | 4.0 g |
| Ammonium thiosulfate (70%) | 175.0 g |
| Sodium bisulfite | 4.6 g |
| Water to make | 1 liter |
| Stabilization solution: | |
| Formalin | 8.0 g |
| Water to make | 1 liter |

Sensitizing Dye I

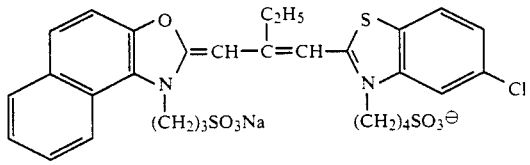

Sensitizing dye II

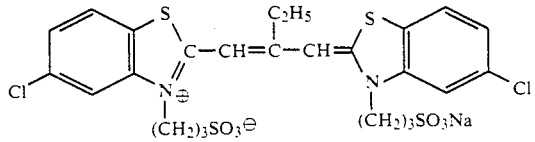

Sensitizing dye III

-continued
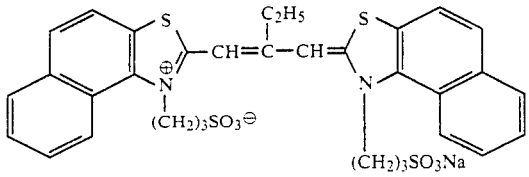
Cp - 1
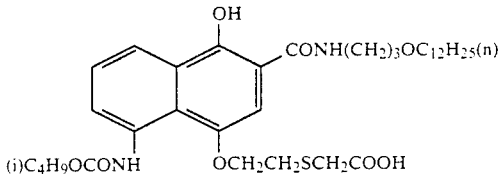
Cp - 2
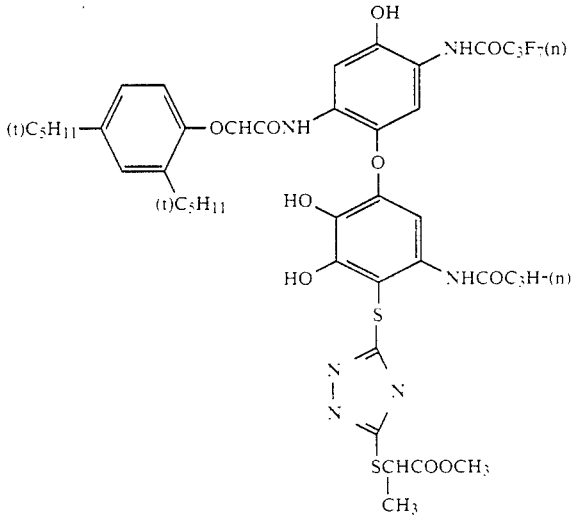
Cp - 3
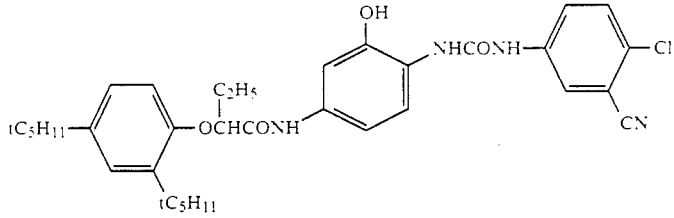
Cp - 4
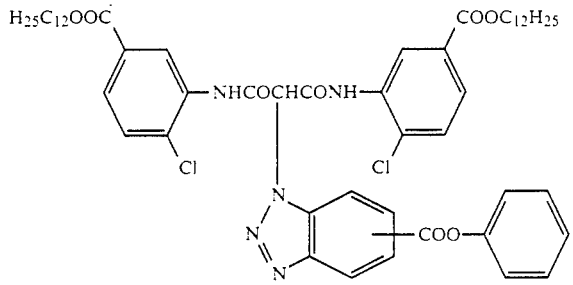
Oil-1 Tricresyl phosphate
Oil-2 Dibutyl phthalate
H-1
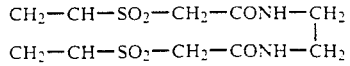

TABLE 2

| Sample No. | Compound | Amount added (g/mol of silver halide) | Relative speed | Fogging |
|---|---|---|---|---|
| 12 | — | — | 100 | 0.16 |
| 13 | (5)* | 0.18 | 130 | 0.17 |
| 14 | (9) | 0.10 | 138 | 0.17 |
| 15 | Comparative Compound (a) | 0.18 | 116 | 0.22 |
| 16 | Comparative Compound (b) | 0.18 | 125 | 0.24 |

Comparative Compound (a): Same as in Example 1
Comparative Compound (b): 1,10-diseleno-4,7,13,16-tetraoxa-cyclooctadecane (Compound disclosed in U.S. Pat. No. 4,782,013)
*The numbers refer to the specific examples of general formulas (I) and (II) described above.

As is clear from Table 2, with compounds of the invention the attainable speed is higher and fogging does not increase as speed increases as much as it does with the Comparison Compounds.

EXAMPLE 3

The compounds noted in Table 3 were added to an aqueous solution containing gelatin and potassium bromide maintained at 60° C. To each of these solutions was then simultaneously added a silver nitrate aqueous solution and a potassium bromide aqueous solution. Silver halide emulsions A to D were produced from these solution by the controlled double jet process in which the pAg was held at 8.3.

An electron microscope was used to determine the average grain sizes of the silver bromide grains produced, findings being noted in Table 3.

As is clear from Table 3, selenoether compounds of the invention made it possible to produce silver bromide grains of generally the same size with smaller addition of the selenoether compound than that of Comparative Compound (a).

TABLE 3

| Emulsion | Compound | Amount added (mlmol/mol of silver halide) | Average grain size (μ) |
|---|---|---|---|
| A | — | — | 0.15 |
| B | (5)* | 1.0 | 0.72 |
| C | (8) | 1.0 | 0.60 |
| D | Comparative Compound (a) | 2.4 | 0.58 |

Comparative Compound (a): same as in Example 1
*The numbers refer to the specific example of general formulas (I) and (II) discribed above.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon a layer which contains at least one compound represented by general formula (I) or general formula (II):

$$Z—R—Se—R'—Z_1 \quad (I)$$

$$Z—R—Se—R'' \quad (II)$$

where

R and R' are each independently represented by general formula (III):

$$(*)—(R_1—X_1—)_n—R_2— \quad (III)$$

where

* represents the bonding to the selenium atom of the general formula (I) or the general formula (II); where $R_1$ and $R_2$ each independently represent a straight chain or branched chain alkylene group, a cycloalkylene group, a straight chain or branched alkenylene group, a straight chain or branched aralkylene group, or an arylene group, and $X_1$ represents —O—, —S—, —Se—,

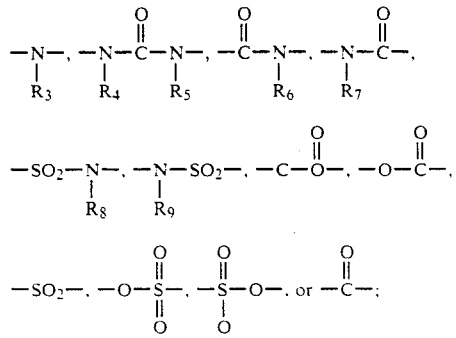

$R_3$, $R_4$, $R_5$, $R_6$, $R_7$, $R_8$, and $R_9$ represent substituted or unsubstituted alkyl groups, substituted or unsubstituted aryl groups, substituted or unsubstituted alkenyl groups, or substituted or unsubstituted aralkyl groups, and n represents an integer 0, 1, 2, or 3;

Z and Z' each individually represent a hydroxyl group, an amino group, an ammonium group, a carboxylic acid group, a salt of a carboxylic acid group, a sulfonic acid group, a salt of sulfonic acid group, an ether group, a thioether group, a selenoether group, a ureido group, thioureido group, an oxycarbonylamino group, an acyl group, a sulfonyl group, a sulfonamido group, an acyloxy group, a sulfonyloxy group, an oxycarbonyl group, an oxysulfonyl group, or heterocyclic group; and R'' represents an alkyl group, a cycloalkyl group, an alkenyl group, an aralkyl group, or an aryl group.

2. The silver halide photographic material of claim 1, wherein $R_1$ and $R_2$ in general formula (III) are straight chain or branched alkylene groups or arylene groups;

$X_1$ is —O—, —S—, —Se—, or

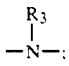

and n is 0 or 1.

3. The silver halide photographic material of claim 1, wherein $R_1$ and $R_2$ in general formula (III) are straight chain or branched alkylene groups;

Z or Z' is a hydroxy group, an amino group, a carboxylic acid group, or a salt of a carboxylic acid group; and R'' is a substituted or unsubstituted alkyl group.

4. The silver halide photographic material of claim 1, wherein the amount of said compound represented by formula (I) or (II) is 0.001 to 30 g per mol of silver halide.

5. The silver halide photographic material of claim 4, wherein the amount of said compound represented by formula (I) or (II) is 0.03 to 10 g per mol of silver halide.

* * * * *